US010350902B2

(12) United States Patent
Miyakoshi et al.

(10) Patent No.: US 10,350,902 B2
(45) Date of Patent: Jul. 16, 2019

(54) INKJET APPARATUS AND COLLECTION APPARATUS

(71) Applicant: CANON KABUSHIKI KAISHA, Tokyo (JP)

(72) Inventors: Arihito Miyakoshi, Tokyo (JP); Masahiko Kubota, Tokyo (JP); Yusuke Imahashi, Kawasaki (JP); Hiroshi Arimizu, Kawasaki (JP); Yoshinori Itoh, Kawasaki (JP); Hideo Sugimura, Tokyo (JP); Takashi Horiba, Kawasaki (JP); Akira Fujikake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/022,433

(22) Filed: Jun. 28, 2018

(65) Prior Publication Data

US 2019/0009567 A1 Jan. 10, 2019

(30) Foreign Application Priority Data

Jul. 6, 2017 (JP) ..... 2017-133043

(51) Int. Cl.

| | |
|---|---|
| ***B41J 2/185*** | (2006.01) |
| ***B41J 2/165*** | (2006.01) |
| *B41J 2/18* | (2006.01) |
| *B41J 25/00* | (2006.01) |

(52) U.S. Cl.

CPC ..... *B41J 2/185* (2013.01); *B41J 2/16552* (2013.01); *B41J 2/18* (2013.01); *B41J 2002/1853* (2013.01); *B41J 2025/008* (2013.01); *B41J 2202/21* (2013.01)

(58) Field of Classification Search

CPC ..... B41J 2/185; B41J 2/16552; B41J 2002/1853; B41J 2202/21; B41J 2025/008; B41J 2/18; B41J 2/1714; B41J 29/17

See application file for complete search history.

(56) References Cited

U.S. PATENT DOCUMENTS

| | | | | |
|---|---|---|---|---|
| 9,315,037 | B2 * | 4/2016 | Gasso Puchal | B41J 2/1714 |
| 2016/0031218 | A1 * | 2/2016 | Ishida | B41J 2/1714 347/34 |
| 2016/0101622 | A1 * | 4/2016 | Sakata | B41J 2/165 347/25 |

FOREIGN PATENT DOCUMENTS

| | | |
|---|---|---|
| JP | 2005-271314 A | 10/2005 |

* cited by examiner

*Primary Examiner* — Geoffrey S Mruk

(74) *Attorney, Agent, or Firm* — Canon U.S.A., Inc. IP Division

(57) ABSTRACT

A collection unit configured to collect ink mist generated due to a discharge of ink from a head configured to discharge the ink includes a filter for capturing the ink mist and a liquid supply portion configured to supply a liquid to the filter.

14 Claims, 13 Drawing Sheets

INKJET APPARATUS AND COLLECTION APPARATUS

BACKGROUND OF THE INVENTION

Field of the Invention

The present disclosure relates to a technique for collecting ink mist in an inkjet apparatus.

Description of the Related Art

Japanese Patent Application Laid-Open No. 2005-271314 discusses a mist collection apparatus for capturing small ink droplets (ink mist), which are generated when ink is discharged from an inject head, by a filter made of a porous body.

In the case of capturing ink mist by a filter made of a porous body as discussed in Japanese Patent Application Laid-Open No. 2005-271314, the ink mist can deposit on the porous body and clog up the filter due to ink adhesion. This is particularly noticeable if the ink is pigment ink containing pigment components. It is therefore a challenge for the practical use of the mist collection apparatus to contrive how to suppress the clogging of the filter for capturing ink mist over a long period of time.

SUMMARY OF THE INVENTION

According to an aspect of the present disclosure, an inkjet recording apparatus includes a head configured to discharge ink, and a collection unit configured to collect ink mist generated due to a discharge of the ink from the head, wherein the collection unit includes a filter configured to capture the ink mist and a liquid supply portion configured to supply a liquid to the filter.

Further features of the present disclosure will become apparent from the following description of exemplary embodiments with reference to the attached drawings.

DESCRIPTION OF THE EMBODIMENTS

An exemplary embodiment of the present disclosure will be described with reference to the drawings. In the diagrams, arrows X and Y indicate horizontal directions which are orthogonal to each other. An arrow Z indicate a vertical direction.

<Recording System>

Figure 1:
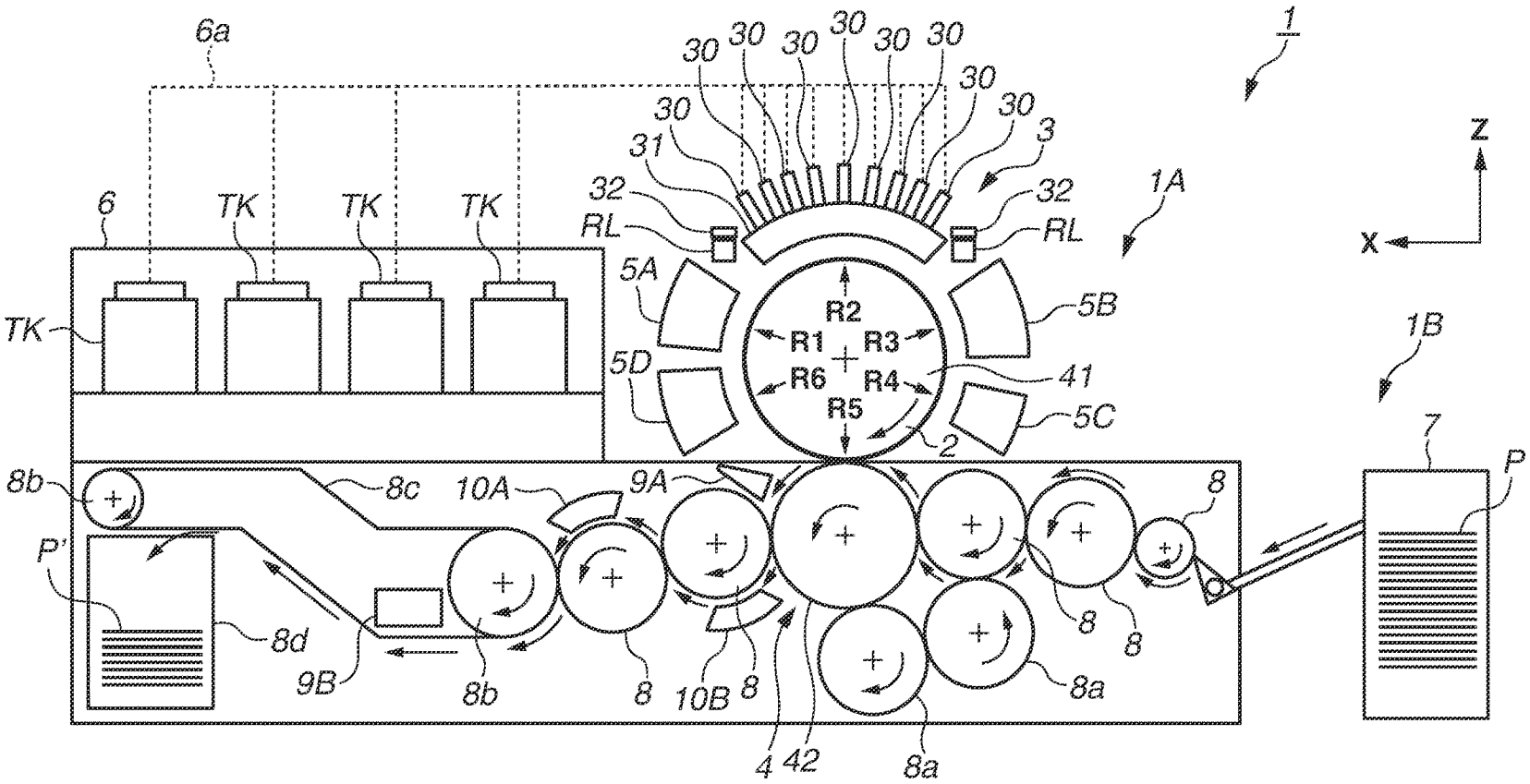
FIG. 1 is a schematic diagram illustrating a recording system.

FIG. 1 is a front view schematically illustrating a recording system 1 according to an exemplary embodiment of the present disclosure. The recording system 1 is a single-sheet inkjet printer which manufactures a recorded product P' by transferring an ink image to a recording medium P via a transfer member 2. The recording system 1 includes a recording apparatus 1A and a conveyance apparatus 1B. In the present example, an X direction, a Y direction, and a Z direction represent a width direction (total length direction), a depth direction, and a height direction of the recording system 1, respectively. The recording medium P is conveyed in the X direction.

"Recording" not only covers a case where meaningful information such as text and graphics is formed, but widely covers cases where an image, markings, or a pattern, meaningful or meaningless, is formed on a recording medium, or the recording medium is so machined, whether visualized to be visually perceptible by a human or not. In the present example, the "recording medium" is assumed to be a sheet of paper, whereas cloth or a plastic film may be used.

The ink is not limited to any particular component. In the present example, aqueous pigment ink which contains a pigment serving as a color material, water, and a resin is assumed to be used.

<Recording Apparatus>

The recording apparatus 1A includes a recording unit 3, a transfer unit 4, peripheral units 5A to 5D, and a supply unit 6.

<Recording Unit>

Figure 2:
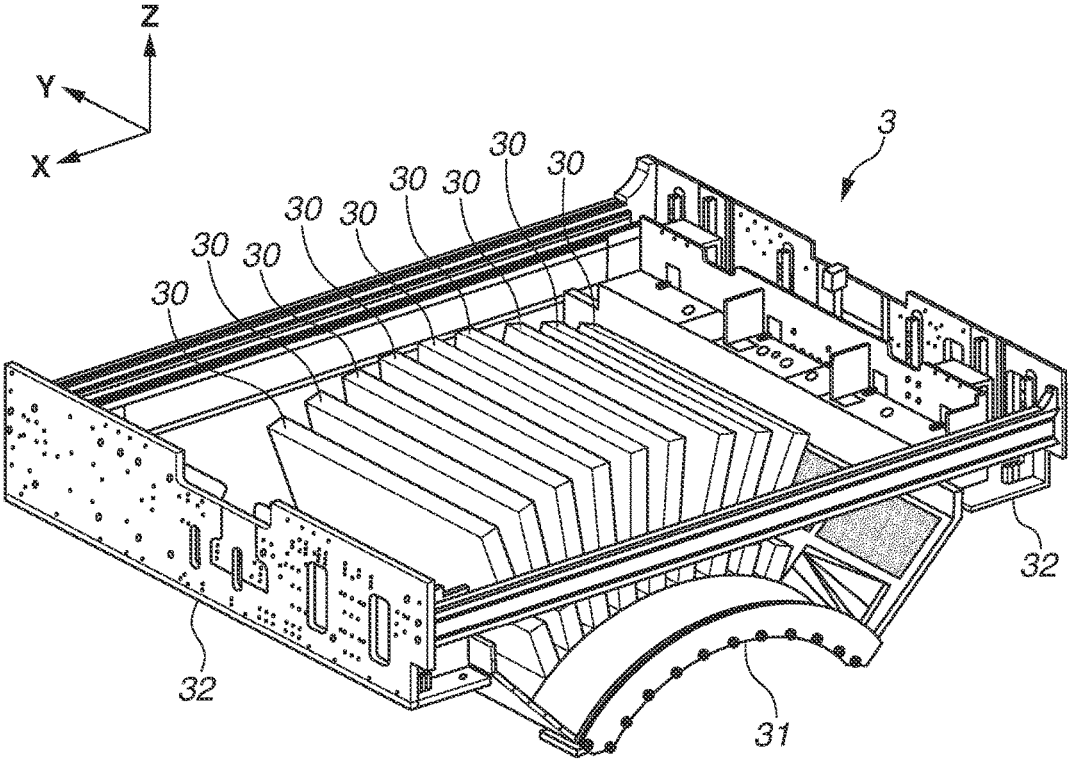
FIG. 2 is a perspective view of a recording unit.
Figure 8:
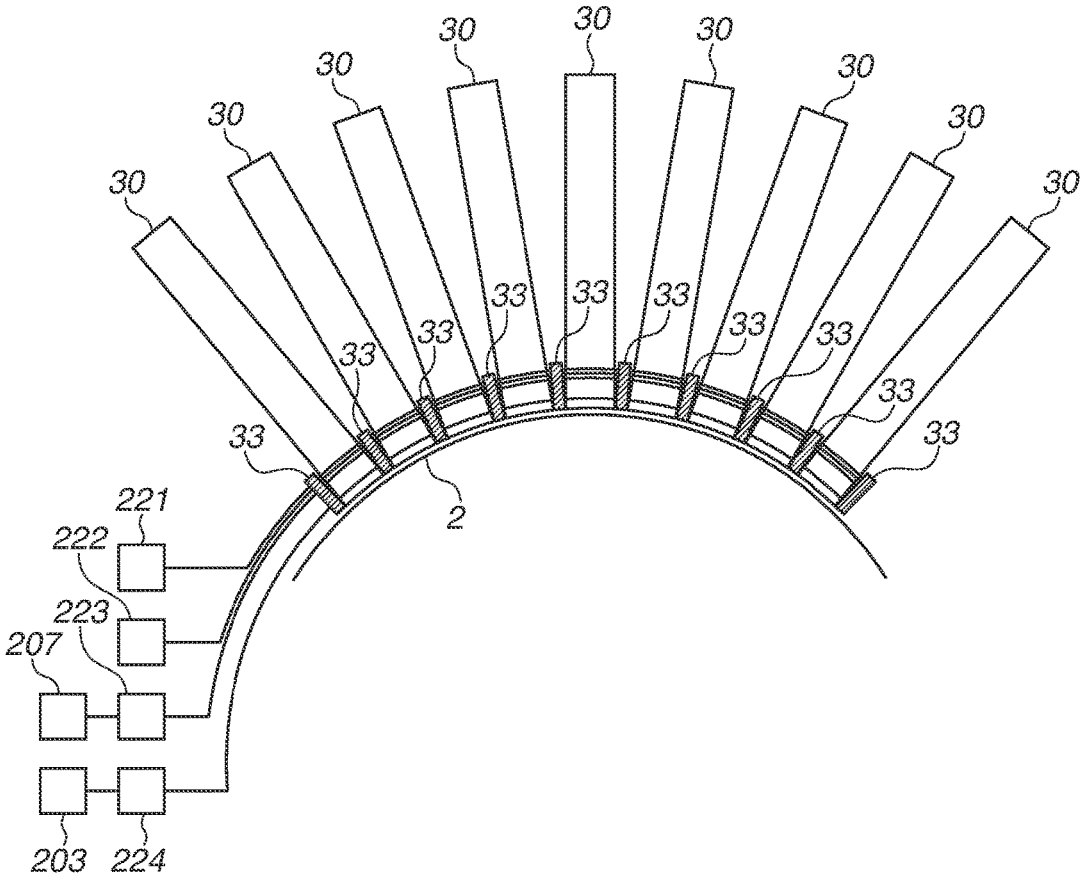
FIG. 8 is a configuration diagram illustrating an arrangement of recording heads and mist collection units.

The recording unit 3 includes a plurality of recording heads 30 and a carriage 31. Refer to FIGS. 1, 2, and 8. FIG. 2 is a perspective view of the recording unit 3. FIG. 8 is a sectional view of the recording unit 3. The recording heads 30 discharge liquid ink to form an ink image of a recording image on the transfer member 2.

In the present example, each recording head 30 is a full-line head extended in the Y direction, and includes nozzles arranged over a range that covers the width of an image recording area on a recording medium of maximum usable size. The recording heads 30 each include at the bottom an ink discharge surface in which the nozzles are opened. The ink discharge surfaces are opposed to the surface of the transfer member 2 via a small gap (for example, several millimeters). In the present example, the transfer member 2 is configured to move in a circulating manner on a circular track. The plurality of recording heads 30 is thus radially arranged.

Each nozzle includes a discharge element. For example, the discharge element is an element that generates pressure inside the nozzle to discharge ink in the nozzle. An inkjet head technology of a conventional inkjet printer may be applied. Examples of the discharge element include an element that discharges ink by causing film boiling of the ink to form a bubble by using an electrothermal transducer, an element that discharges ink by using an electromechanical transducer, and an element that discharges ink by using static electricity. In view of high-speed high-density recording, discharge elements using electrothermal transducers can be used.

In the present example, the recording unit 3 includes nine recording heads 30. The recording heads 30 discharge respective different types of ink. Examples of the different types of ink include inks containing different color materials, such as yellow ink, magenta ink, cyan ink, and black ink. One recording head 30 discharges one type of ink. One recording head 30 may be configured to discharge a plurality of types of ink. If a plurality of recording heads 30 is thus provided, some of the recording heads 30 may discharge ink that includes no color material (such as clear ink).

As illustrated in FIG. 8, mist collection units 33 are provided at eight positions each sandwiched between adjoining two of the nine recording heads 30. The mist collection units 33 collect ink mist that is generated when ink is discharged from the recording heads 30. Mist collection units 33 are also provided at a position adjoining the upstream side of the most upstream recording head 30 and at a position adjoining the downstream side of the most downstream recording head 30. In other words, the recording heads 30 and the mist collection units 33 are alternately arranged radially along the outer peripheral surface of the transfer member 2. Each mist collection unit 33 includes blowing ports for blowing air toward the surface of the transfer member 2 and a suction port for sucking in air. The blowing ports and the suction port are formed in a lower part of a unit housing of the mist collection unit 33. By blowing out clean air from the blowing ports and sucking in air from the suction port, ink mist generated from the recording heads 30 is effectively collected before diffusing widely in the recording apparatus 1A.

The carriage 31 supports the plurality of recording heads 30 and the plurality of mist collection units 33. Each recording head 30 is fixed to the carriage 31 at an end on the ink discharge surface side. This can maintain the gap between the ink discharge surface and the surface of the transfer member 2 more precisely. The carriage 31 is configured to be movable with the recording heads 30 mounted thereon, as guided by guide members RL. In the present example, the guide members RL are rail members extended in the Y direction. A pair of guide members RL are arranged at a distance from each other in the X direction. Slide portions 32 are provided on respective sides of the carriage 31 in the X direction. The slide portions 32 are engaged with the guide members RL and slide along the guide members RL in the Y direction.

Figure 3:
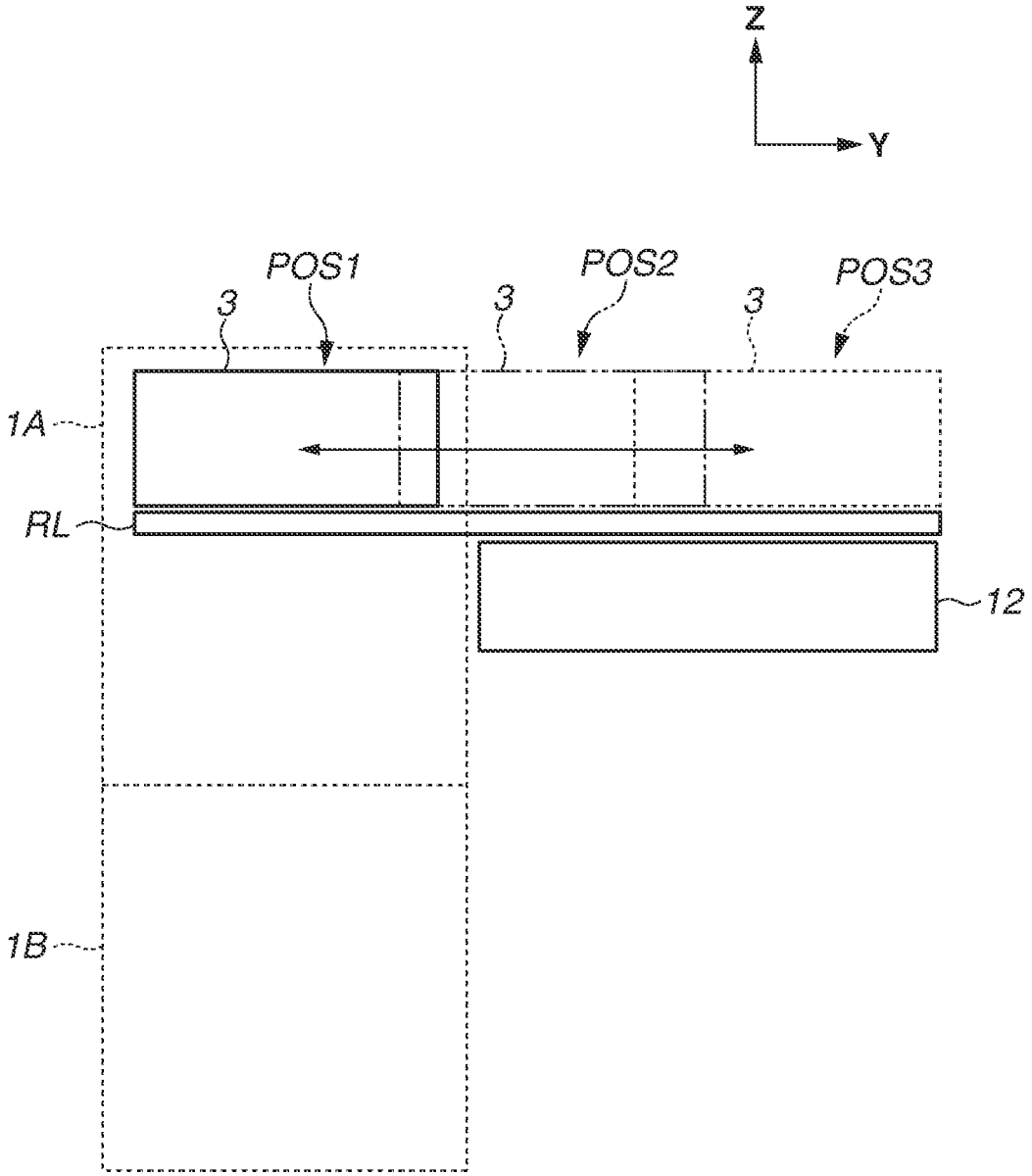
FIG. 3 is an explanatory diagram illustrating a mode of displacement of the recording unit illustrated in FIG. 2.

FIG. 3 is a diagram illustrating a mode of displacement of the recording unit 3. FIG. 3 schematically illustrates a right side surface of the recording system 1. A recovery unit 12 is arranged behind the recording system 1. The recovery unit 12 includes a mechanism for recovering discharge performance of the recording heads 30. Examples of such a mechanism include a cap mechanism for capping the ink discharge surfaces of the recording heads 30, a wiper mechanism for wiping the ink discharge surfaces, and a suction mechanism for sucking the ink inside the recording heads 30 from the ink discharge surfaces by negative pressure.

The guide members RL are extended from beside the transfer member 2 to over the recovery unit 12. Guided by the guide members RL, the recording unit 3 can make a displacement between a discharge position POS1 where the recording unit 3 is illustrated in solid lines and a recovery position POS3 where the recording unit 3 is illustrated in broken lines. The recording unit 3 is moved by a not-illustrated driving mechanism.

The discharge position POS1 is a position where the recording unit 3 discharges ink to the transfer member 2. At the discharge position POS1, the ink discharge surfaces of the recording heads 30 face the surface of the transfer member 2. The recovery position POS3 is a position where the recording unit 3 is retracted from the discharge position POS1. At the recovery position POS3, the recording unit 3 lies over the recovery unit 12. If the recording unit 3 is located at the recovery position POS3, the recovery unit 12 can perform recovery processing on the recording heads 30. In the present example, recovery processing can also be performed during movement before the recording unit 3 reaches the recovery position POS3. There is a preliminary recovery position POS2 between the discharge position POS1 and the recovery position POS3. The recovery unit 12 can perform preliminary recovery processing on the recording heads 30 at the preliminary recovery position POS2 while the recording heads 30 are moving from the discharge position POS1 to the recovery position POS3.

<Transfer Unit>

The transfer unit 4 will be described with reference to FIG. 1. The transfer unit 4 includes a transfer drum 41 (transfer cylinder) and an impression cylinder 42. The cylinders are rotating bodies which rotate about rotation axes extending in the Y direction, and have a cylindrically shaped outer peripheral surface. In FIG. 1, the arrows illustrated in the figures of the transfer drum 41 and the impression cylinder 42 indicate the rotation directions of the transfer drum 41 and the impression cylinder 42. The transfer drum 41 rotates clockwise. The impression cylinder 42 rotates counterclockwise.

The transfer drum 41 is a support member for supporting the transfer member 2 on its outer peripheral surface. The transfer member 2 is circumferentially continuously or intermittently provided on the outer peripheral surface of the transfer drum 41. If the transfer member 2 is continuously provided, the transfer member 2 is formed in an endless belt shape. If the transfer member 2 is intermittently provided, the transfer member 2 is formed as a plurality of separate segments of non-endless belt shape. The segments can be arranged in a circular arc at equal pitches on the outer peripheral surface of the transfer drum 41.

As the transfer drum 41 rotates, the transfer member 2 moves to circulate on a circular track. According to the rotational phase of the transfer drum 41, the position of the transfer member 2 can be divided into a discharge preprocessing region R1, a discharge region R2, discharge post-processing regions R3 and R4, a transfer region R5, and a transfer post-processing region R6. The transfer member 2 circulates through the regions R1 to R6.

The discharge preprocessing region R1 is a region where preprocessing is performed on the transfer member 2 before a discharge of ink by the recording unit 3. In the discharge preprocessing region R1, processing by the peripheral unit 5A is performed. In the present example, a reaction liquid is applied. The discharge region R2 is a formation region where the recording unit 3 discharges ink to the transfer member 2 to form an ink image. The discharge post-processing regions R3 and R4 are processing regions where processing on the ink image is performed after the discharge of the ink. In the discharge post-processing region R3, processing by the peripheral unit 5B is performed. In the discharge post-processing region R4, processing by the peripheral unit 5C is performed. The transfer region R5 is a region where the ink image on the transfer member 2 is transferred to a recording medium P by the transfer unit 4. The transfer post-processing region R6 is a region where post-processing on the transfer member 2 is performed after the transfer. In the transfer post-processing region R6, processing by the peripheral unit 5D is performed.

In the present example, the discharge region R2 is a region including a section of a certain size. The sections of the other regions R1 and R3 to R6 are narrower than that of the discharge region R2. In terms of a clock dial, in the present example, the discharge preprocessing region R1 is located at approximately ten. The discharge region R2 ranges from approximately eleven to one. The discharge post-processing region R3 is located at approximately two. The discharge post-processing region R4 is located at approximately four. The transfer region R5 is located at approximately six. The transfer post-processing region R6 is at approximately eight.

The transfer member 2 may include a single layer or a stack of plurality of layers. In the case of a plurality of layers, for example, the transfer member 2 may include three layers including a surface layer, an elastic layer, and a compression layer. The surface layer is the outermost layer having an image formation surface on which an ink image is formed. If the compression layer is provided, the compression layer can absorb deformation and distribute local pressure variations, whereby transferability can be maintained even during high speed recording. The elastic layer lies between the surface layer and the compression layer.

The surface layer may be made of various materials including resin and ceramic materials as appropriate. In view of durability, a material having high compression elasticity can be used. Specific examples include acrylic resins, acrylic silicone resins, fluorine-containing resins, and condensates obtained by condensing hydrolytic organic silicon compounds. To improve image transferability and wettability to the reaction liquid, a surface treatment may be applied to the surface layer. Examples of the surface treatment include a flame treatment, a corona treatment, a plasma treatment, polishing, roughening, active energy ray irradiation, an ozone treatment, a surfactant treatment, and a silane coupling treatment. More than one of such treatments may be combined. An arbitrary surface shape may be formed on the surface layer.

The compression layer may be made of materials such as acrylonitrile-butadiene rubber, acrylic rubber, chloroprene rubber, urethane rubber, and silicone rubber. In molding such rubber materials, a predetermined amount of vulcanizing agent or vulcanization accelerator may be compounded. A foaming agent or a filler such as hollow fine particles and salt may be compounded as appropriate to form a porous rubber material. Since the resulting bubble portions are compressed with a volume change under various pressure changes, more stable transferability and durability can be obtained with less deformation in directions other than the direction of compression. Porous rubber materials include ones having a continuous open cell structure in which pores are continuous with each other, and ones having a closed cell structure in which pores are independent of each other. Either structure may be used. Both the structures may be used in combination.

The elastic layer may be a member made of various materials including resin and ceramic materials as appropriate. In terms of machining properties, various elastomer materials and rubber materials can be used. Specific examples include fluorosilicone rubber, phenyl silicone rubber, fluorocarbon rubber, chloroprene rubber, urethane rubber, and nitrile rubber. Other examples include ethylene propylene rubber, natural rubber, styrene rubber, isoprene rubber, butadiene rubber, ethylene/propylene/butadiene copolymer, and nitrile butadiene rubber. In particular, silicone rubber, fluorosilicone rubber, and phenyl silicone rubber have a low compression set, and are thus advantageous in terms of dimensional stability and durability. These rubbers are also advantageous in terms of transferability since their elasticity does not change much with temperature.

Various adhesives and double-sided adhesive tapes may be used between the surface layer and the elastic layer and between the elastic layer and the compression layer for the purpose of fixing. To suppress lateral elongation in attaching the transfer member 2 to the transfer drum 41 and maintain resilience, the transfer member 2 may include a reinforcing layer having a high compression modulus of elasticity. Woven fabric may be used as the reinforcing layer. The transfer member 2 may be fabricated by arbitrarily combining layers made of the foregoing materials.

The outer peripheral surface of the impression cylinder 42 is pressed against the transfer member 2. At least one gripping mechanism for holding a leading portion of the recording medium P is provided on the outer peripheral surface of the impression cylinder 42. A plurality of gripping mechanisms may be provided at a distance from each other in the circumferential direction of the impression cylinder 42. The recording medium P is conveyed in close contact with the outer peripheral surface of the impression cylinder 42. When the recording medium P passes through a nip portion between the impression cylinder 42 and the transfer member 2, the ink image on the transfer member 2 is transferred to the recording medium P.

The transfer drum 41 and the impression cylinder 42 can be driven by a common driving source such as a motor. A transmission mechanism such as a gear mechanism can be used to distribute the driving force.

<Peripheral Units>

The peripheral units 5A to 5D are arranged around the transfer drum 41. In the present example, the peripheral units 5A, 5B, 5C, and 5D are an application unit, an absorption unit, a heating unit, and a cleaning unit, respectively.

The application unit 5A is a mechanism for applying the reaction liquid to the transfer member 2 before the discharge of ink by the recording unit 3. The reaction liquid is a liquid containing a component for increasing the viscosity of the ink. Increasing the viscosity of the ink refers to a state where the color material or resin constituting the ink is brought into contact with the component for increasing the viscosity of the ink and thereby chemically reacting with or physically sticking to each other, so that the viscosity of the ink appears to increase. Increasing the viscosity of the ink not only covers the case where the viscosity of the entire ink appears to increase, but also covers cases where some of the components constituting the ink, such as the color material and the resin, aggregate to cause a local increase in viscosity.

The component for increasing the viscosity of the ink is not limited in particular, and may be metal ions or a polymer aggregating agent. Substances that cause a pH change of the ink to aggregate the color material in the ink can be used. Organic acids may be used. Examples of the mechanism for applying the reaction liquid include a roller, a recording head, a die coating device (die coater), and a blade coating device (blade coater). If the reaction liquid is applied to the transfer member 2 before the discharge of the ink to the transfer member 2, the ink reaching the transfer member 2 can be immediately fixed. This can suppress bleeding, i.e., mixing of adjoining inks.

The absorption unit 5B is a mechanism for absorbing liquid components from the ink image on the transfer member 2 before transfer. Bleeding of the image recorded on the recording medium P can be suppressed by reducing the liquid components of the ink image. To put it another way, the reduction of the liquid components may be referred to as condensation of the ink constituting the ink image on the transfer member 2. Condensing the ink means that the liquid components included in the ink decrease and the ratio of the solid content included in the ink, such as the color material and resin, to the liquid components increases.

The absorption unit 5B includes, for example, a liquid absorbing member for making contact with the ink image to reduce the amount of liquid components in the ink image. The liquid absorption member may be formed on the outer peripheral surface of a roller. The liquid absorption member may be formed in an endless sheet shape and run to circulate. In view of protection of the ink image, the moving speed of the liquid absorption member may be made the same as the circumferential speed of the transfer member 2 so that the liquid absorption member moves in synchronization with the transfer member 2.

The liquid absorption member may include a porous body to make contact with the ink image. To suppress adhesion of the solid content of the ink to the liquid absorption member, the porous body on the surface to make contact with the ink image may have a pore size of 10 μm or less. As employed herein, the pore size refers to an average diameter which can be measured by conventional means such as mercury porosimetry, a nitrogen absorption method, and scanning electron microscope (SEM) image observation. The liquid components are not limited in particular as long as the components do not have a fixed shape, and have fluidity and a substantially constant volume. Examples of the liquid components include water and an organic solvent contained in the ink or reaction liquid.

The heating unit 5C is a mechanism for heating the ink image on the transfer member 2 before transfer. Heating the ink image melts the resin in the ink image and improves transferability to the recording medium P. The heating temperature can be at or above the minimum film-formation temperature (MFT) of the resin. The MFT can be measured by commonly known techniques, such as by using an instrument compliant with Japanese Industrial Standard (JIS) K 6828-2: 2003 or the International Organization for Standardization (ISO) 2115: 1996. In view of transferability and image fastness, the heating may be performed at a temperature 10° C. or more higher than the MFT. The heating may be performed at a temperature 20° C. or more higher than the MFT. Conventional heating devices may be used as the heating unit 5C. Examples include various lamps such as an infrared lamp, and a hot air fan. In view of heating efficiency, an infrared heater can be used.

The cleaning unit 5D is a mechanism for cleaning the surface of the transfer member 2 after transfer. The cleaning unit 5D removes ink remaining on the transfer member 2 and dust on the transfer member 2. The cleaning unit 5D can use conventional methods as appropriate. Examples include a method for bringing a porous body into contact with the transfer member 2, a method for sweeping the surface of the transfer member 2 with a brush, and a method for scraping the surface of the transfer member 2 with a blade. Cleaning members of conventional shapes, such as a roller shape and a web shape, can be used for cleaning.

As described above, in the present example, the application unit 5A, the absorption unit 5B, the heating unit 5C, and the cleaning unit 5D are provided as the peripheral units. Some of the units may be equipped with a function of cooling the transfer member 2. Alternatively, a cooling unit may be added. In the present example, the temperature of the transfer member 2 may increase due to the heat of the heating unit 5C. If, after the ink is discharged to the transfer member 2 by the recording unit 3, the temperature of the ink image exceeds the boiling point of water which is the main solvent of the ink, the absorption performance of the liquid components by the absorption unit 5B may drop. The absorption performance of the liquid components can be maintained by cooling the transfer member 2 so that the temperature of the discharged ink is maintained below the boiling point of water.

The cooling unit may be a blower mechanism for blowing air to the transfer member 2 or a mechanism for bringing a member (such as a roller) into contact with the transfer member 2 and cooling the member by air or water. The cooling unit may be a mechanism for cooling the cleaning member of the cleaning unit 5D. The cooling timing may be a period after a transfer and before the application of the reaction liquid.

<Supply Unit>

The supply unit 6 is a mechanism for supplying ink to the recording heads 30 of the recording unit 3. The supply unit 6 may be provided on a rear side of the recording system 1. The supply unit 6 includes reservoir units TK for reserving respective types of inks. Each reservoir unit TK may include a main tank and a sub tank. The reservoir units TK and the recording heads 30 communicate via flow channels 6*a*, and the inks are supplied from the reservoir units TK to the recording heads 30. The flow channels 6*a* may be ones for circulating ink between the reservoir units TK and the recording heads 30. The supply unit 6 may include a pump for circulating ink. A deaerator mechanism for releasing bubbles in the ink may be provided in the middle of the flow channels 6*a* or on the reservoir units TK. A valve for regulating the liquid pressure of ink to the air pressure may be provided in the middle of the flow channels 6*a* or on the reservoir units TK. The heights of the reservoir units TK and the recording heads 30 in the Z direction may be designed so that the ink levels in the reservoir units TK are below the ink discharge surfaces of the recording heads 30.

<Conveyance Apparatus>

The conveyance apparatus 1B is an apparatus for feeding a recording medium P to the transfer unit 4 and discharging a recorded product P', to which an ink image is transferred, from the transfer unit 4. The conveyance apparatus 1B includes a feeding unit 7, a plurality of conveyance cylinders 8 and 8*a*, two sprockets 8*b*, a chain 8*c*, and a collection unit 8*d*. In FIG. 1, the arrows inside the figures of the components of the conveyance apparatus 1B indicate the rotation directions of the components. The arrows outside the figures of the components indicate the conveyance path of the recording medium P or the recorded product P'. The recording medium P is conveyed from the feeding unit 7 to the transfer unit 4. The recorded product P' is conveyed from the transfer unit 4 to the collection unit 8*d*. The feeding unit 7 side may be referred to as an upstream side in the conveyance direction, and the collection unit 8*d* side a downstream side.

The feeding unit 7 includes a stacking unit in which a plurality of recording media P is stacked, and a feeding mechanism for feeding the recording media P one by one from the stacking unit to the most-upstream conveyance cylinder 8. The conveyance cylinders 8 and 8*a* are rotating bodies which rotate about rotation axes extending in the Y direction, and have a cylindrically shaped outer peripheral surface. At least one gripping mechanism for holding a leading portion of the recording medium P (or recorded product P') is provided on the outer peripheral surface of each of the conveyance cylinders 8 and 8*a*. Gripping and releasing operations of the gripping mechanisms are controlled so that the recording medium P (or recorded product P') is passed between adjoining conveyance cylinders.

The two conveyance cylinders 8*a* are for reversing the recording medium P. In performing two-sided recording on the recording medium P, the recording medium P after a transfer to the front side thereof is passed from the impression cylinder 42 to the conveyance cylinder 8*a* instead of the conveyance cylinder 8 adjacent to the impression cylinder 42 on the downstream side. The recording medium P is reversed via the two conveyance cylinders 8*a*, and passed to the impression cylinder 42 again via the conveyance cylinder 8 on the upstream side of the impression cylinder 42. The back side of the recording medium P thereby faces the transfer drum 41, and an ink image is transferred to the back side thereof.

The chain 8*c* is wound between the two sprockets 8*b*. One of the two sprockets 8*b* is a driving sprocket, and the other a driven sprocket. The chain 8*c* is run to circulate by the rotation of the driving sprocket. A plurality of gripping mechanisms is provided on the chain 8*c* at distances in the longitudinal direction. Each gripping mechanism grips an end of a recorded product P'. Recording products P' are passed from the conveyance cylinder 8 located downstream to the gripping mechanisms of the chain 8*c*. The recorded products P' gripped by the griping mechanisms are conveyed to the collection unit 8*d* by the running of the chain 8*c*, and then the gripping is released. In such a manner, the recorded products P' are stacked in the collection unit 8*d*.

<Post-Processing Units>

The conveyance apparatus 1B includes post-processing units 10A and 10B. The post-processing units 10A and 10B are mechanisms that are arranged downstream of the transfer unit 4 and perform post-processing on the recorded product P'. The post-processing unit 10A performs processing on the front side of the recorded product P'. The post-processing unit 10B performs processing on the back side of the recorded product P'. Examples of the processing include coating on an image recording surface of the recorded product P' for the purpose of image protection or gloss finishing. Examples of the coating include liquid application, sheet welding, and lamination.

<Inspection Units>

The conveyance apparatus 1B includes inspection units 9A and 9B. The inspection units 9A and 9B are mechanisms that are arranged downstream of the transfer unit 4 and inspect the recorded product P'.

In the present example, the inspection unit 9A is an imaging apparatus which captures an image recorded on the recorded product P'. For example, the inspection unit 9A includes an image sensor such as a charge-coupled device (CCD) sensor and a complementary metal-oxide-semiconductor (CMOS) sensor. The inspection unit 9A captures the recorded image during a recording operation which is continuously performed. Based on the image captured by the inspection unit 9A, a secular change in the tint of the recorded image can be checked to determine whether the image data or the recording data needs to be corrected. In the present example, the imaging range of the inspection unit 9A is set to the outer peripheral surface of the impression cylinder 42. The inspection unit 9A is arranged so that the recorded image immediately after transfer can be captured in part. The inspection unit 9A may inspect all recorded images or perform inspection on every predetermined number of images.

In the present example, the inspection unit 9B is also an imaging apparatus which captures an image recorded on the recorded product P'. For example, the inspection unit 9B includes an image sensor such as a CCD sensor and a CMOS sensor. The inspection unit 9B captures the recorded image in a test recording operation. The inspection unit 9B can capture the entire recorded image and, based on the image captured by the inspection unit 9B, make basic settings for various corrections about the recording data. In the present example, the inspection unit 9B is arranged at a position for imaging the recorded product P' conveyed by the chain 8*c*. In capturing the recorded image, the inspection unit 9B captures the entire recorded image while the running of the chain 8*c* is temporarily stopped. The inspection unit 9B may be a scanner for scanning over the recorded product P'.

<Control Unit>

Figure 4:
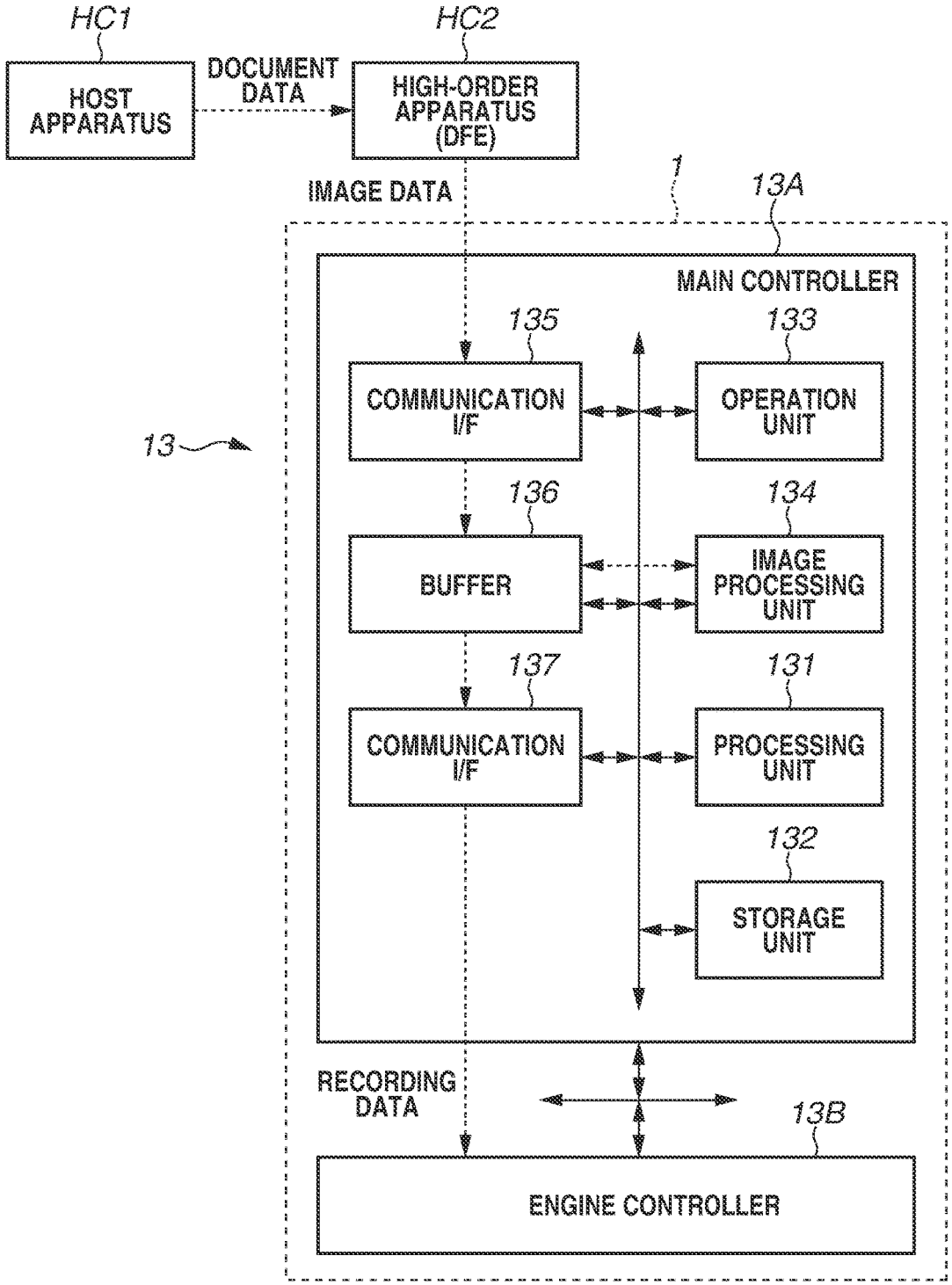
FIG. 4 is a block diagram of a control system of the recording system illustrated in FIG. 1.
Figure 5:
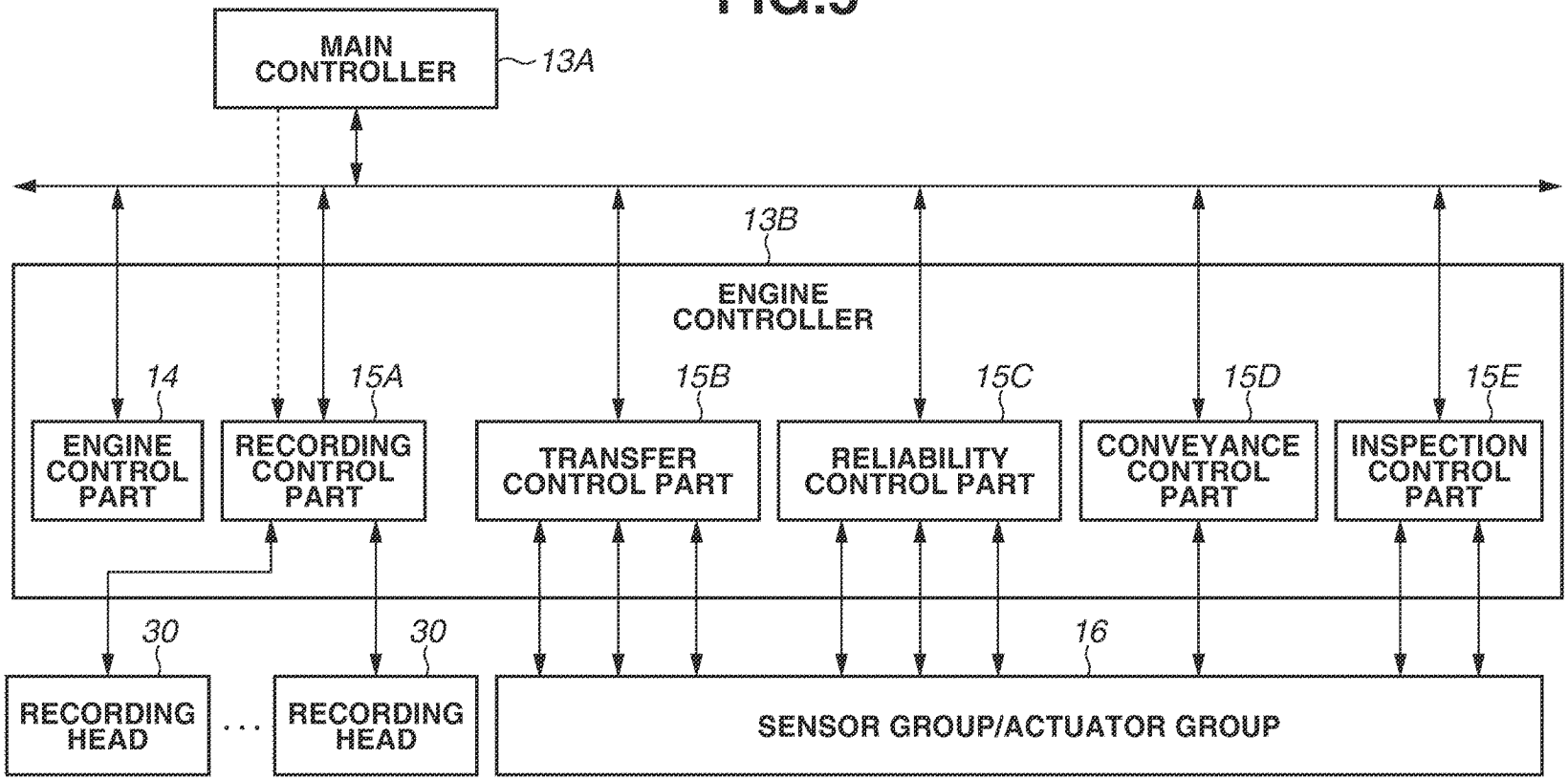
FIG. 5 is a block diagram of the control system of the recording system illustrated in FIG. 1.

Next, a control unit of the recording system 1 will be described. FIGS. 4 and 5 are block diagrams illustrating a control unit 13 of the recording system 1. The control unit 13 is communicably connected to a high-order apparatus (digital front end (DFE)) HC2. The high-order apparatus HC2 is communicably connected to a host apparatus HCl.

The host apparatus HCl generates or stores document data serving as a source of a recording image. For example, the document data here is generated in the form of an electronic file such as a document file and an image file. The document data is transmitted to the high-order apparatus HC2. The high-order apparatus HC2 converts the received document data into a data format usable by the control unit 13 (for example, red, green, and blue (RGB) data expressing an image in RGB values). The converted data is transmitted from the high-order apparatus HC2 to the control unit 13 as image data. The control unit 13 starts a recording operation based on the received image data.

In the present example, the control unit 13 is broadly divided into a main controller 13A and an engine controller 13B. The main controller 13A includes a processing unit 131, a storage unit 132, an operation unit 133, an image processing unit 134, a communication interface (I/F) 135, a buffer 136, and a communication I/F 137.

The processing unit 131 is a processor such as a central processing unit (CPU). The processing unit 131 executes a program stored in the storage unit 132 and controls the entire main controller 13A. The storage unit 132 is a storage device such as a random access memory (RAM), a read-only memory (ROM), a hard disk, and a solid state drive (SSD). The storage unit 132 stores the program to be executed by the processing unit 131 and data, and provides a work area for the processing unit 131. The operation unit 133 is an input device such as a touch panel, a keyboard, and a mouse. The operation unit 133 accepts user's instructions.

An example of the image processing unit 134 is an electronic circuit including an image processing processor. Examples of the buffer 136 includes a RAM, a hard disk, and an SSD. The communication I/F 135 communicates with the high-order apparatus HC2. The communication I/F 137 communicates with the engine controller 13B. In FIG. 4, broken-lined arrows illustrate a processing flow of the image data. The image data received from the high-order apparatus HC2 via the communication I/F 135 is stored into the buffer 136. The image processing unit 134 reads the image data from the buffer 136, applies predetermined image processing to the read image data, and stores the resulting image data into the buffer 136 again. The image data after the image processing, stored in the buffer 136, is transmitted from the communication I/F 137 to the engine controller 13B as the recording data to be used by a print engine.

As illustrated in FIG. 5, the engine controller 13B includes various control parts 14 and 15A to 15E. The engine controller 13B obtains detection results of a sensor group/actuator group 16 included in the recording system 1, and performs driving control on the sensor group/actuator group 16. The control parts 14 and 15A to 15E each include a processor such as a CPU, a storage device such as a RAM and a ROM, and interfaces with external devices. The classification of the control parts 14 and 15A to 15E is just an example. Some of the controls may be performed by a plurality of subdivided control parts. Conversely, a plurality of control parts may be integrated into one so that the controls of the plurality of control parts are performed by one control part.

The engine control part 14 performs control on the entire engine controller 13B. The recording control part 15A converts the recording data received from the main controller 13A into a data format suited to drive the recording heads 30, such as raster data. The recording control part 15A performs discharge control on each recording head 30.

The transfer control part 15B performs control on the application unit 5A, control on the absorption unit 5B, control on the heating unit 5C, and control on the cleaning unit 5D.

The reliability control part 15C performs control on the supply unit 6, control on the recovery unit 12, and control on a driving mechanism for moving the recording unit 3 between the discharge position POST and the recovery position POS3.

The conveyance control part 15D performs control on the conveyance apparatus 1B. The inspection control part 15E performs control on the inspection unit 9B and control on the inspection unit 9A.

The sensor group/actuator group 16 includes a sensor group and an actuator group. The sensor group includes a sensor for detecting the position and speed of a movable part, a sensor for detecting temperature, and an image sensor. The actuator group includes a motor, an electromagnetic solenoid, and an electromagnetic valve.

<Operation Example>

Figure 6:
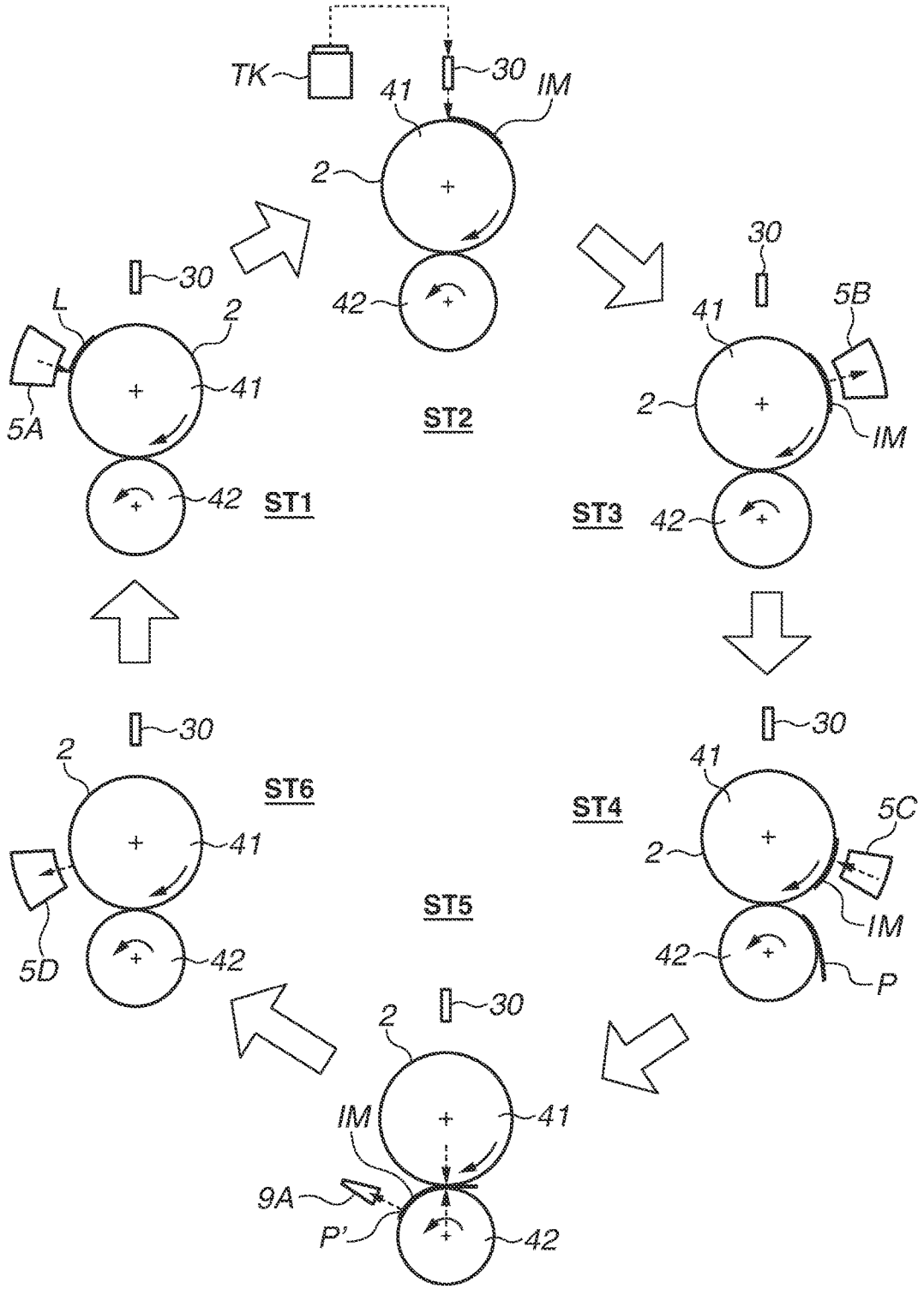
FIG. 6 is an explanatory diagram illustrating an operation example of the recording system illustrated in FIG. 1.

FIG. 6 is a diagram schematically illustrating an example of a recording operation. The following steps are cyclically performed while the transfer drum 41 and the impression cylinder 42 are rotated. As illustrated in state ST1, the application unit 5A initially applies a reaction liquid L to the transfer member 2. The portion to which the reaction liquid L is applied on the transfer member 2 moves according to the rotation of the transfer drum 41. If the portion to which the reaction liquid L is applied reaches a position under a recording head 30, as illustrated in state ST2, the recording head 30 discharges ink to the transfer member 2. An ink image IM is thereby formed. Here, the discharged ink is mixed with the reaction liquid L on the transfer member 2, whereby the aggregation of the color material is promoted. The ink to be discharged is supplied from the reservoir unit TK of the supply unit 6 to the recording head 30.

The ink image IM on the transfer member 2 moves according to the rotation of the transfer member 2. If the ink image IM reaches the absorption unit 5B, as illustrated in state ST3, the absorption unit 5B absorbs liquid components from the ink image IM. If the ink image IM reaches the heating unit 5C, as illustrated in state ST4, the heating unit 5C heats the ink image IM. The resin in the ink image IM melts to form a film of the ink image IM. A recording medium P is conveyed by the conveyance apparatus 1B in synchronization with the formation of the ink image IM.

As illustrated in state ST5, the ink image IM and the recording medium P reach the nip portion between the transfer member 2 and the impression cylinder 42. The ink image IM is transferred to the recording medium P, whereby a recorded product P' is manufactured. Past the nip portion, the image recorded on the recorded product P' is captured by the inspection unit 9A, and the recorded image is inspected. The recorded product P' is conveyed to the collection unit 8*d* by the conveyance apparatus 1B.

If the portion where the ink image IM has been formed on the transfer member 2 reaches the cleaning unit 5D, as illustrated in state ST6, the portion is cleaned by the cleaning unit 5D. After the cleaning, one rotation of the transfer member 2 is completed. In a similar procedure, the transfer of ink images IM to recording media P is repeated. In the foregoing description, for ease of understanding, the transfer of an ink image IM to one recording medium P is described to be performed once in one rotation of the transfer member 2. However, ink images IM can be successively transferred to a plurality of recording media P in one rotation of the transfer member 2.

Figure 7:
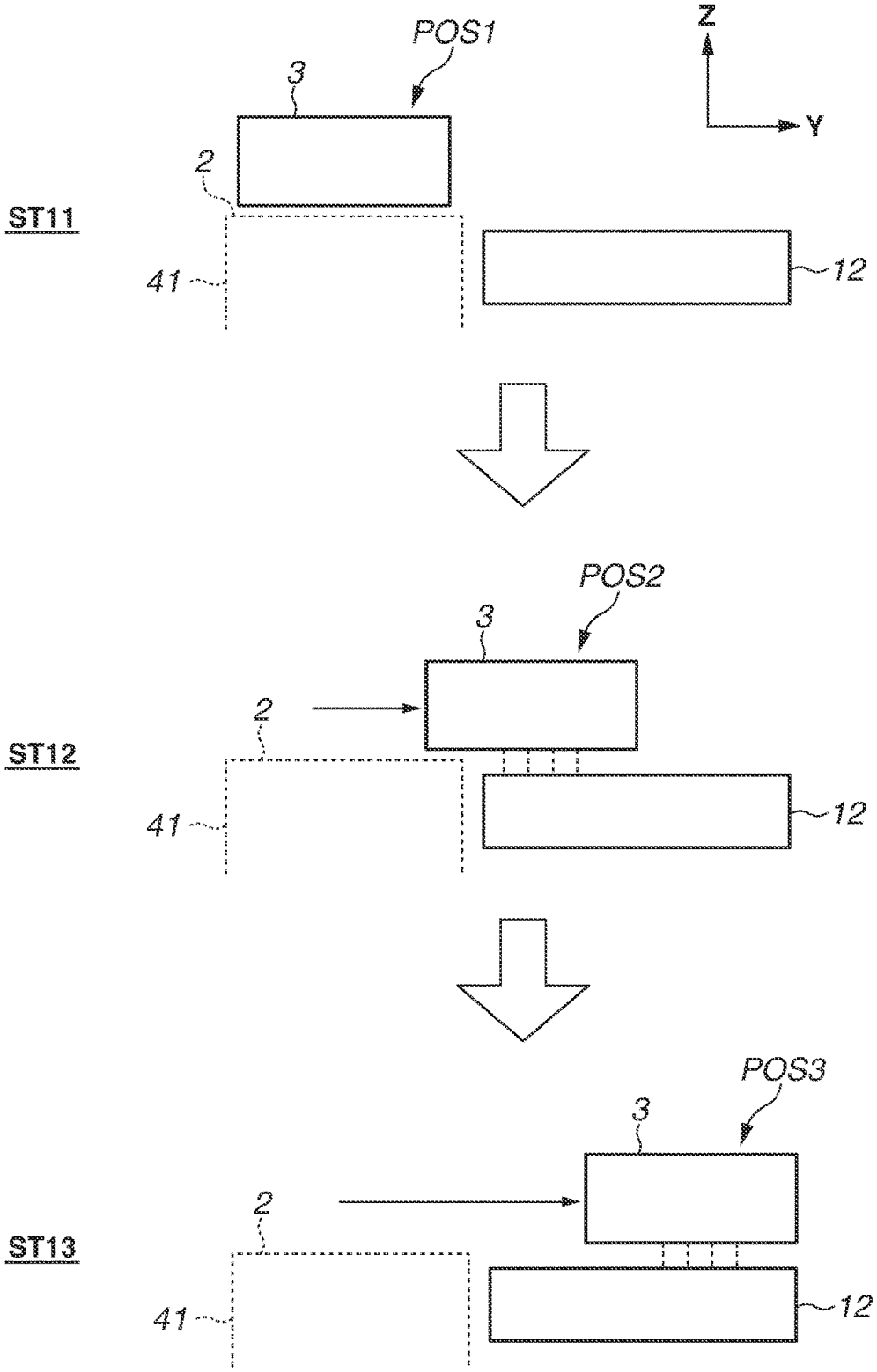
FIG. 7 is an explanatory diagram illustrating an operation example of the recording system illustrated in FIG. 1.

The recording heads 30 need maintenance if such a recording operation is continued. FIG. 7 illustrates an operation example during maintenance of the recording heads 30. State ST11 illustrates a state in which the recording unit 3 is located at the discharge position POST. State ST12 illustrates a state in which the recording unit 3 is passing the preliminary recovery position POS2. During the passage, the recovery unit 12 performs processing for recovering the discharge performance of the recording heads 30 of the recording unit 3. As illustrated in state ST13, the recording unit 3 is then located at the recovery position POS3, in which state the recovery unit 12 performs the processing for recovering the discharge performance of the recording heads 30.

In the foregoing exemplary embodiment, the recording unit 3 is described to include a plurality of recording heads 30. However, the recording unit 3 may include one recording head 30. The recording heads 30 do not need to be full-line heads. The recording heads 30 may be serial heads which form an ink image while scanning in the Y direction.

The conveyance mechanism of the recording medium P may employ other methods, such as one for sandwiching and conveying the recording medium P by roller pairs. If a method for conveying the recording medium P by roller pairs is employed, the recording medium P may be a roll sheet. The recorded product P' may be manufactured by cutting the roll sheet after transfer. In the foregoing exemplary embodiment, the transfer member 2 is arranged on the outer peripheral surface of the transfer drum 41. However, other methods may be employed. For example, the transfer member may be formed in an endless belt shape and run to circulate.

<Details of Mist Collection Units>

A detailed structure of the mist collection units 33 for collecting ink mist (hereinafter, may be referred to simply as mist) hanging in the air in the recording apparatus 1A will be described below.

Figure 9:
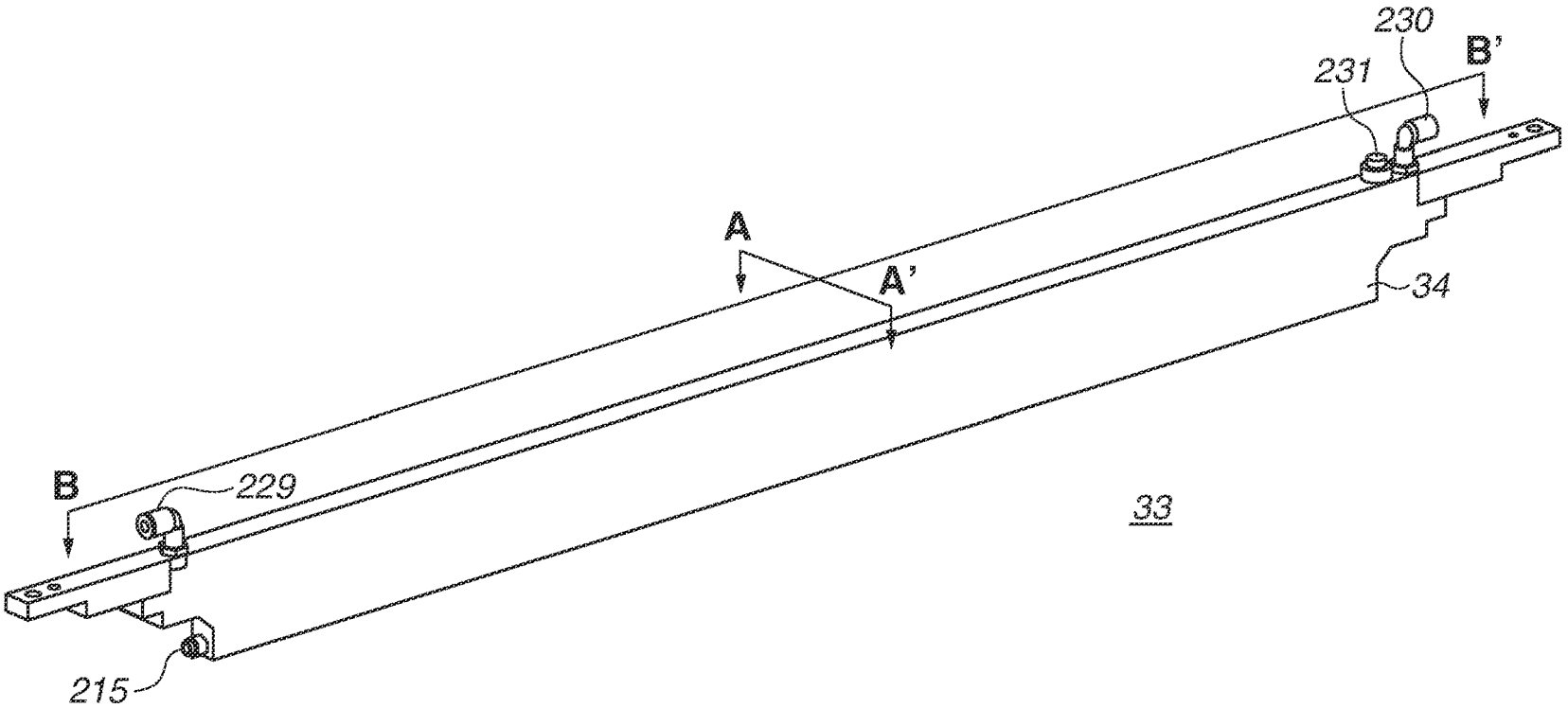
FIG. 9 is a perspective view illustrating an appearance of a mist collection unit.

FIG. 9 is a perspective view illustrating an appearance of one of the mist collection units 33 in FIG. 8. A housing 34 (unit casing) of the mist collection unit 33 has a shape long in the same direction as the longitudinal direction of the recording heads 30 (line heads). A liquid inlet 229 for liquid supply to be described below, a liquid outlet 215 for liquid drainage, an air inlet 230 for sending air into the housing 34, and an air outlet 231 for exhausting the air from inside the housing 34 are provided at the ends of the housing 34.

Figure 10:
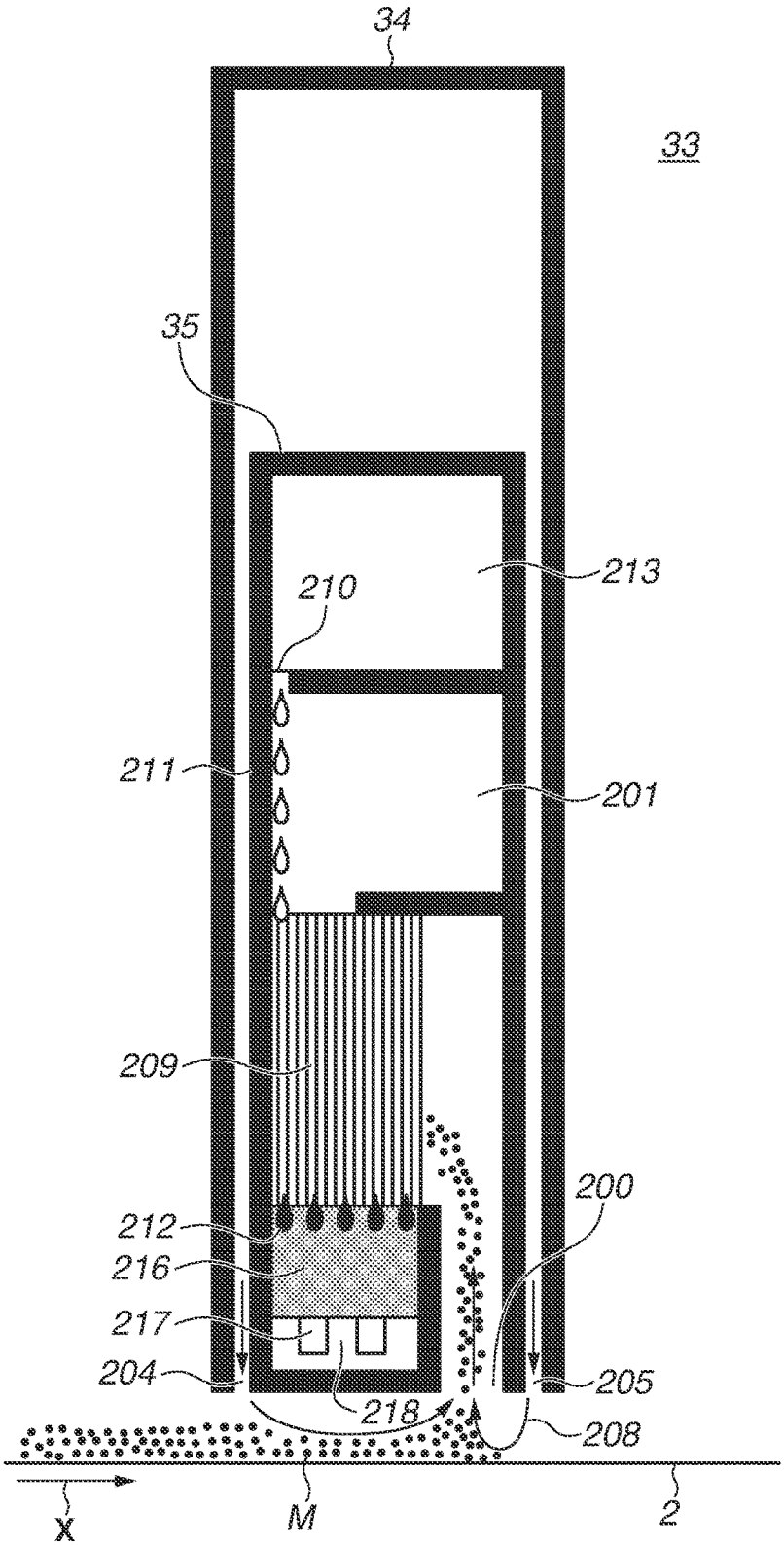
FIG. 10 is a sectional view illustrating an internal configuration of the mist collection unit.
Figure 11A:
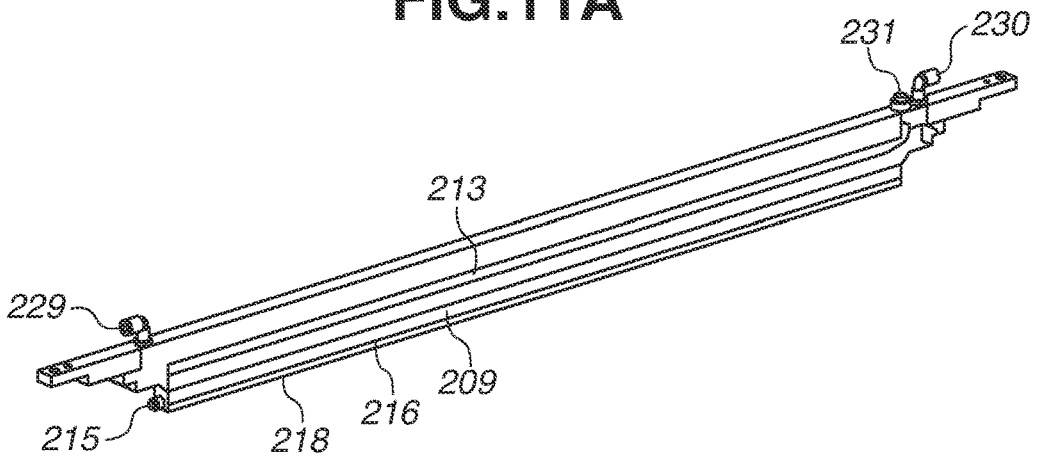
FIGS. 11A, 11B, and 11C are sectional perspective views of the mist collection unit.
Figure 11B:
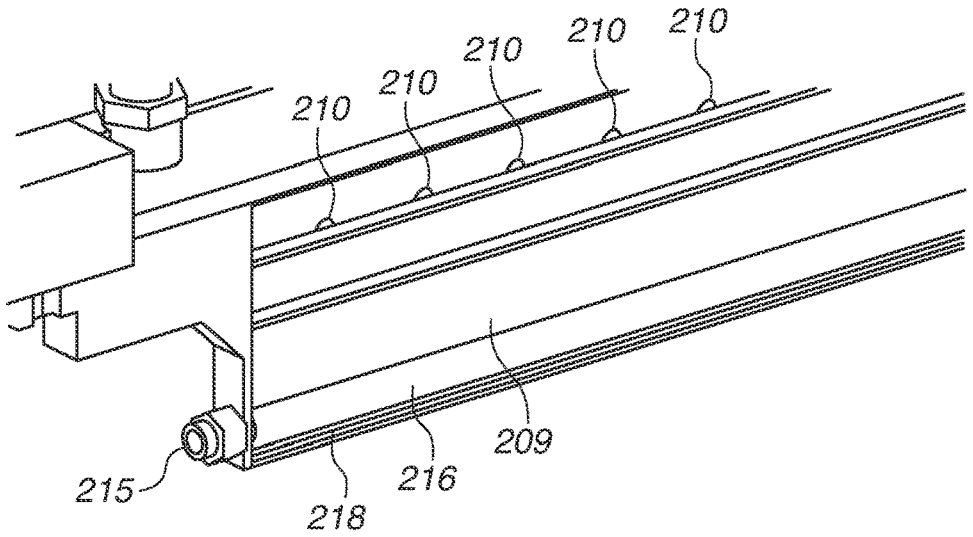

FIG. 10 is a sectional view illustrating an internal structure, taken along the line A-A' of FIG. 9. FIG. 11A is a sectional perspective view taken along the line B-B' of FIG. 9. FIG. 11B is a partial enlarged view of an end of the mist collection unit 33.

In FIG. 10, the mist collection unit 33 includes an outer housing 34 (outer casing) and an inner housing 35 (inner casing) accommodated inside. To blow clean air toward the surface of the transfer member 2, an upstream blowing port 204 and a downstream blowing port 205 are formed in the bottom of the mist collection unit 33. The upstream and downstream blowing ports 204 and 205 are formed as slit-shaped gaps between the outer housing 34 and the inner housing 35. A suction port 200 in a slit shape for sucking air into the interior of the inner housing 35 is also provided at the bottom of the mist collection unit 33. The downstream blowing port 205 and the suction port 200 are adjacent to each other with a wall of the inner housing 35 therebetween. To blow air from the upstream and downstream blowing ports 204 and 205, a pressure generation unit including a pressure pump 221 (see FIG. 8) generates and sends pressurized air. The pressure generation unit is provided for the plurality of mist collection units 33 in common. Piping leading to the pressure generation unit is connected to the air inlet 230 (see FIG. 11A) provided at one end of the outer housing 34.

FIG. 10 illustrates how mist M flows. With attention focused on one mist collection unit 33, mist M generated from the recording head 30 arranged upstream flows in under the mist collection unit 33 along a moving direction X as the transfer member 2 moves. The air blown from the upstream blowing port 204 forms a laminar flow along the surface of the mist collection unit 33 opposed to the transfer member 2. The laminar flow serves as an air barrier for suppressing adhesion of the flown-in mist M to the opposed surface. Meanwhile, the air blown from the downstream blowing port 205 produces a whirl of air 208 below the suction port 200. The whirl of air 208 blows up the mist M flowing near the surface of the transfer member 2 toward the suction port 200. In such a manner, much mist M is sucked into the suction port 200.

In one mist collection unit 33, the space inside the outer housing 34 and above the inner housing 35 serves as an inlet buffer chamber for buffering the pressure of the air to be supplied to the upstream and downstream, two blowing ports 204 and 205. The inner housing 35 includes an exhaust buffer chamber 201 for exhausting the air sucked in from the suction port 200 out of the inner housing 35. The exhaust buffer chamber 201 functions as a buffering space for regulating the exhaust air pressure. A negative pressure generation unit including a negative pressure pump 222 (see FIG. 8) is connected at the end of the exhaust buffer chamber 201, and the air is exhausted by negative pressure. The negative pressure generation unit is provided for the plurality of mist collection units 33 in common. Piping leading to the negative pressure generation unit is connected to the air outlet 231 (see FIG. 11A) provided at one end of the outer housing 34.

In the inner housing 35, the suction port 200 communicates with the exhaust buffer chamber 201 via a filter 209, whereby an air flow from the suction port 200 to the exhaust buffer chamber 201 is formed. The filter 209 includes a porous body. The filter 209 separates the mist-containing air sucked and collected into the interior of the mist collection unit 33 into air and mist (liquid), and captures the mist. The air past the filter 209 is passed through the exhaust buffer chamber 201 and exhausted out of the mist collection unit 33. The filter 209 functions as a gas-liquid separation filter which captures the mist by the porous body and lets only the air through. The mist-hanging air sucked in from the suction port 200 thus enters the filter 209 from a side surface, passes through the interior of the filter 209, and exits the filter 209 from the top surface. In microscopic terms, the mist is captured by a large number of fine pores in the porous body when passing through the filter 209. The clean air passed through the filter 209 without much ink mist hanging is exhausted from the exhaust buffer chamber 201 to outside the inner housing 35.

The mist (small ink droplets) captured by the filter 209 becomes liquid in the filter 209. If the filter 209 in which much mist is captured is left for a long time, the pigment components of the ink can adhere to the surface of the filter 209 and clog up the filter 209. Since the interior of the filter 209 (pores of the porous body) becomes less pervious to air and the pressure loss of the filter 209 increases, the air suction force through the suction port 200 decreases. This means a drop in the mist collection performance of the mist collection unit 33. The recording apparatus 1A is then devised to suppress the clogging of the filter 209 over a long period of time.

The basic idea is to supply a liquid different from the ink, such as pure water, to the filter 209 to maintain the filter 209 wet with the liquid. The liquid is supplied to the filter 209 for the following plurality of purposes.

(1) To maintain the filter 209 in an appropriate wet state and delay the evaporation of liquid from the surface of the filter 209 so that the adhesion of the pigment components of the ink to the surface of the filter 209 from drying is suppressed.

(2) To wash the captured ink mist off the filter 209 with the liquid.

<Liquid Supply Portion>

As illustrated in FIG. 10, a liquid supply portion 213 is provided in the upper part of the inner housing 35. Liquid 211 is supplied from the liquid supply portion 213 to the filter 209. The liquid supply portion 213 is arranged inside the inner housing 35 and above the filter 209, and the liquid 211 moves down from the liquid supply portion 213 to the filter 209 by gravity. More specifically, the liquid 211 from a hole 210 in the bottom of the liquid supply portion 213 flows down the inner wall of the inner housing 35 by gravity and reaches the top surface of the filter 209. The liquid supply portion 213 may be configured so that the liquid 211 drips and moves directly from the hole 210 onto the top surface of the filter 209 without flowing along the inner wall.

As illustrated in FIG. 11A, the liquid supply portion 213 is formed as a long narrow flow channel having a rectangular cross section (rectangular pipe), extended along the longitudinal direction of the inner housing 35. A plurality of holes 210 is formed at equal distances along the longitudinal direction. The liquid 211 flows through the flow channel of the liquid supply portion 213, and the liquid 211 is supplied toward the top surface of the filter 209 in a long shape from each of the plurality of holes 210. To make the amounts of the liquid 211 supplied from the plurality of holes 210 uniform overall in the longitudinal direction, the cross-sectional area of each hole 210 can be set to 1/100 or less the inner area of the rectangular pipe. The liquid supply portion 213 does not necessarily need to be a rectangular pipe. For example, the liquid supply portion 213 may be a circular pipe.

A liquid supply unit including a liquid storage tank 207 and a pressure pump 223 (see FIG. 8) is connected at the end of the liquid supply portion 213. The liquid in the liquid storage tank 207 is fed into the liquid supply portion 213 by the pressure pump 223. Piping leading to the liquid supply unit is connected to the liquid inlet 229 (see FIG. 11A) provided at the top of one end of the outer housing 34. Liquid inlets 229 may be provided on both ends of the outer housing 34 so that the liquid is fed from both the liquid inlets 229.

In the present example, the liquid 211 supplied to the filter 209 is pure water (ion exchanged water). A surface active agent may be added thereto. The addition of the surface active agent lowers the surface tension of the liquid 211 so that the liquid 211 can be supplied to the filter 209 with lower supply pressure. The addition of the surface active agent also provides the effects of promoting mist dissolution and promoting water permeation to a porous wall. The liquid 211 does not necessarily need to be pure water. Any type of liquid may be used as long as the filter 209 can be cleaned.

<Draining Mechanism>

The mist collection unit 33 includes a draining mechanism for draining waste liquid (a mixture of the cleaning liquid and ink obtained by condensed mist) from under the filter 209 so that the liquid 211 supplied to the filter 209 does not overflow. A waste liquid collection unit including a waste liquid tank 203 and a negative pressure pump 224 (see FIG. 8) is connected at the end of the draining mechanism. The waste liquid drained from the mist collection unit 33 is collected by the negative pressure pump 224 and stored in the waste liquid tank 203. Piping leading to the waste liquid collection unit is connected to the liquid outlet 215 (see FIGS. 11A and 11B) provided under one end of the outer housing 34. Liquid outlets 215 may be provided on both ends of the outer housing 34 so that the liquid 211 is drained from both the liquid outlets 215.

As illustrated in FIG. 10, the mist separated from the air by the filter 209 becomes liquid and moves down in the filter 209 by capillary force, along with the liquid 211 previously absorbed in the filter 209. To draw out the liquid stored in the filter 209 from the filter 209, a liquid transfer member 216 (liquid transfer unit) made of a porous body different from that of the filter 209 is arranged under the filter 209. Like the filter 209, the liquid transfer member 216 has a long narrow shape. An end of the liquid transfer member 216 may be put in contact with or at a distance from the liquid outlet 215.

The top surface of the liquid transfer member 216 is put in close contact with the bottom surface of the filter 209 by surface contact. By such a structure, liquid 212 in the lower part of the filter 209 moves to the upper part of the liquid transfer member 216.

Figure 11C:
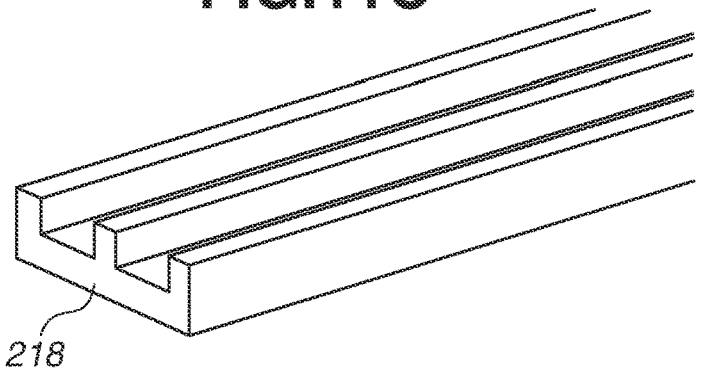

If the liquid absorbed in the liquid transfer member 216 exceeds the maximum water retention capacity of the porous body, the excessive liquid seeps out of the porous body. A drain channel 217 serving as a receptor for receiving the overflown liquid is provided directly below the liquid transfer member 216. As illustrated in FIG. 11C, the drain channel 217 is formed as a groove member having two long grooves of recessed rail shape. The liquid overflown from the liquid transfer member 216 to the drain channel 217 moves to the liquid outlet 215 along the long grooves, and is drained from the mist collection unit 33 and stored into the waste liquid tank 203 as waste liquid. The drain channel 217 does not necessarily need to be formed by using such a groove member. The bottom of the inner surface of the inner housing 35 itself may be used as a drain channel. Here, if the bottom of the inner housing 35 has a rectangular sectional shape, the resulting drain channel is rectangular. If the bottom is U-shaped, the drain channel is U-shaped.

<Porous Body>

Now, details of the respective porous materials of the filter 209 and the liquid transfer member 216 will be described. In the present example, the filter 209 includes a fibrous porous body. If fiber-to-fiber distances between a large number of fibers constituting the porous body are too small, the pressure loss of the filter 209 increases. If the fiber-to-fiber distances are too large, the mist capturing (trapping) efficiency decreases. Considering such conditions, the fibers constituting the porous body can have an average fiber-to-fiber distance d within the range of 30 μm to 200 μm. The porous body constituting the filter 209 is not limited to a porous material, and may be a continuous open cell member or a mesh porous body typified by a stainless porous body. Even in such cases, in terms of balance between the pressure loss and the capturing efficiency, both the pore size of the continuous open cell member and the mesh size of the mesh porous body can be within the range of 30 μm to 200 μm.

The liquid transfer member 216 needs to be conditioned so that the liquid efficiently moves from the filter 209 to the liquid transfer member 216. One condition is that the liquid transfer member 216 is made of a porous body having higher water absorbing power than that of the filter 209. Another condition is that the liquid transfer member 216 has surface energy higher than that of the filter 209. The porous body of the liquid transfer member 216 can be a continuous open cell member having a porosity of 80% or more and a pore diameter within the range of 50 μm to 600 μm, more favorably 80 μm to 200 μm. Examples of the continuous open cell member include a polyvinyl alcohol (PVA) porous body and a urethane porous body. If such conditions are satisfied, the liquid moves efficiently from the filter 209 to the liquid transfer member 216.

As the filter 209 absorbs the liquid and increases in water content, a large number of pores in the porous body become filled with the liquid, the interior of the filter 209 becomes less pervious to the air, and the pressure loss of the filter 209 increases. This means a drop in the efficiency of the gas-liquid separation by the filter 209, i.e., a drop in the collection power of the mist collection unit 33. To maintain the collection efficiency needed of the mist collection unit 33, the water content of the filter 209 needs to be managed within an appropriate range. According to an investigation by the inventors, the needed mist collection rate can be obtained if the pressure loss of the filter 209 is 1 kPa or less. To satisfy this, the water content of the filter 209 during use can be 30% or less. To obtain the foregoing effects of (1) suppressing drying of the surface of the filter 209 and (2) cleaning the filter 209, the water content of the filter 209 can be 5% or more. With such upper and lower limits combined, a favorable condition is that the filter 209 has a water content within the range of 5% to 30% when the recording apparatus 1A is in use.

The management of the amount of liquid supply to the filter 209 is also important. According to an investigation by the inventors, a mass increase of the filter 209 is maintained in a stable state of 1% or less with respect to the initial state if the amount of liquid supply per hour is 20 times the volume of the filter 209. The liquid can be supplied at predetermined timing, rather than constantly. For example, when the recording apparatus 1A is in operation, the liquid is supplied for a fixed duration at each predetermined time. The liquid is also supplied before the recording apparatus 1A is powered off, so that the filter 209 is cleaned before the recording apparatus 1A is shut down.

The amount of liquid to be drained from the liquid outlet 215 is set so that the amount of the liquid 211 supplied and the amount of the liquid drained are almost the same. This establishes a balanced state between the liquid supply and the drainage, whereby the foregoing favorable condition of the water content, i.e., the range of 5% to 30% can be maintained.

As described above, according to the present exemplary embodiment, a liquid other than the ink is supplied to the filter (gas-liquid separation filter) 209, and the filter 209 is used in a wet state. The adhesion of the pigment components of the ink to the surface of the filter 209 from drying is suppressed by maintaining the filter 209 in an appropriate wet state to delay the evaporation of liquid from the surface of the filter 209. In addition, the liquid can clean the filter 209 stained with the captured ink mist and discharge the stain. An excellent inkjet apparatus in which filter clogging is suppressed over a long period of time can thus be implemented.

<Modifications>

Next, several modifications of the internal structure of the mist collection unit 33 will be described with reference to the drawings. Members having similar functions to those of the foregoing exemplary embodiment are designated by the same reference numerals. A redundant description thereof will be omitted.

Figure 12:
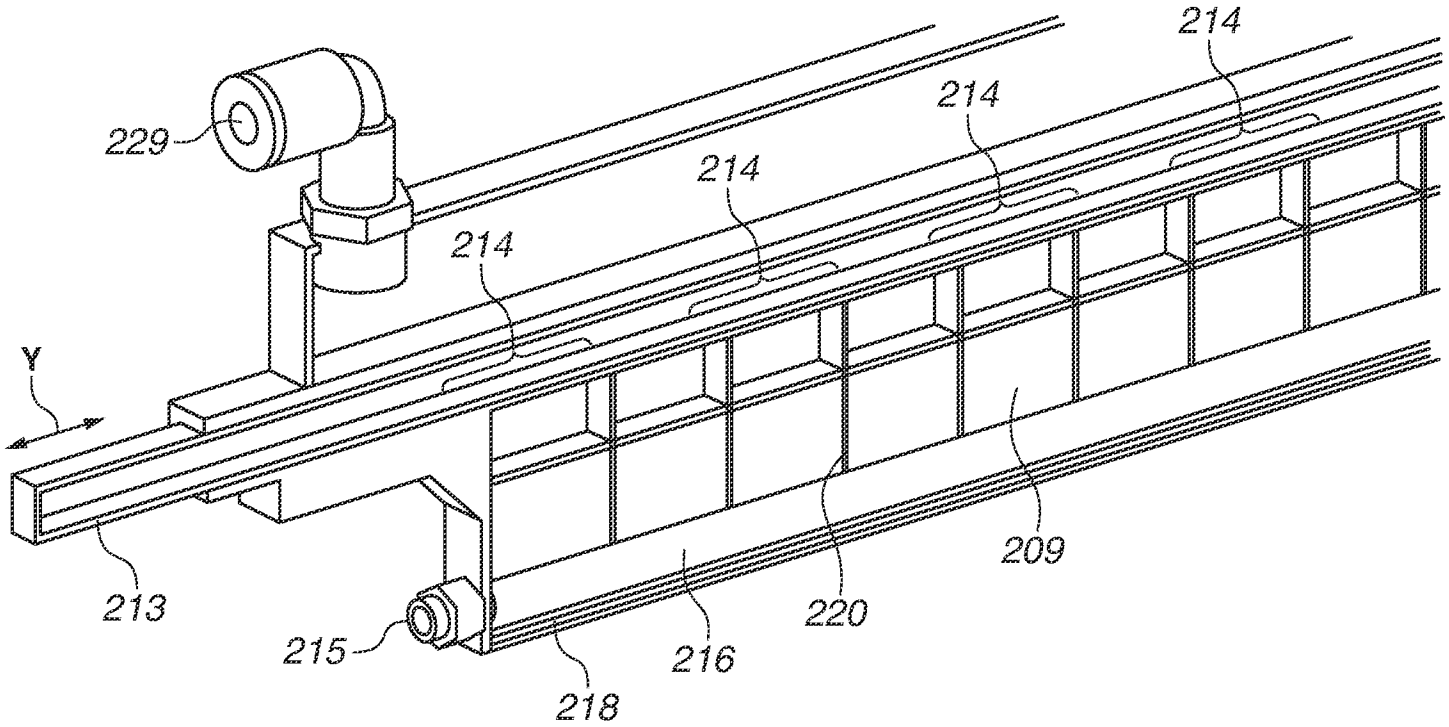
FIG. 12 is a sectional perspective view of a mist collection unit according to a first modification.

FIG. 12 illustrates a structure of the mist collection unit 33 according to a first modification. Unlike the foregoing example of FIGS. 11A to 11C, the filter 209 is divided into a plurality of small pieces. Adjoining pieces of the filter 209 are partitioned by a partition plate 220. The long, narrow liquid supply portion 213 has liquid-supplying holes 214 which are formed for every other of the plurality of pieces of the filter 209 arranged in the longitudinal direction. The liquid supply portion 213 can be longitudinally moved to a first position and a second position by a driving mechanism. The distance between the first and second positions is the same as the longitudinal width of a piece of the filter 209. If the liquid supply portion 213 is at the first position, the plurality of pieces of the filter 209 is divided into cleaning regions and mist capturing regions which are alternately arranged. The cleaning regions are supplied with the liquid from the holes 214. The mist capturing regions are not supplied with the liquid, since no hole 214 is located above. In other words, half of the entire filter 209 is cleaned while the remaining half performs efficient mist capturing. If the liquid supply portion 213 is moved to the second position, the alternately-arranged cleaning regions and mist capturing regions are replaced with each other. The regions to be cleaned and the regions to capture the mist can be alternately switched by changing the position of the liquid supply portion 213 between the first position and the second position at every predetermined apparatus operation time. The partition plates 220 are not indispensable, and adjoining pieces of the filter 209 may be partitioned by an empty space. The liquid supply portion 213 may be fixed, and the pieces of the filter 209 may be configured to be moved.

Figure 13A:
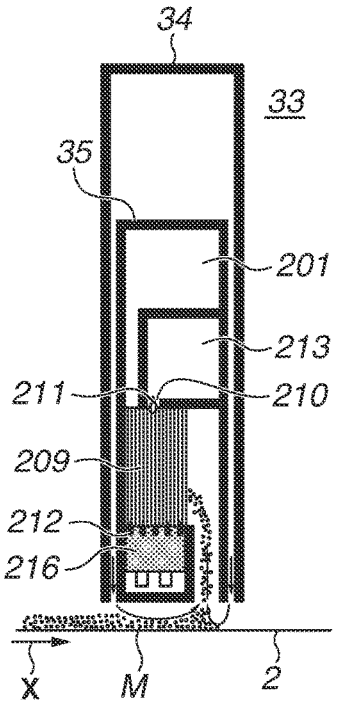
FIGS. 13A, 13B, 13C, 13D, and 13E are sectional views of mist collection units according to second to sixth modifications.

FIG. 13A illustrates a structure of the mist collection unit 33 according to a second modification. The second modification is characterized in that, compared to the foregoing example of FIG. 10, the liquid supply portion 213 is lowered in position and rearranged to come under the exhaust buffer chamber 201. The lower surface of the liquid supply portion 213 is in contact with the top surface of the filter 209, so that the liquid from the holes 210 immediately enters the filter 209. This enables stable liquid transfer no matter how the mist collection unit 33 is arranged to tilt as illustrated in FIG. 8.

Figure 13B:
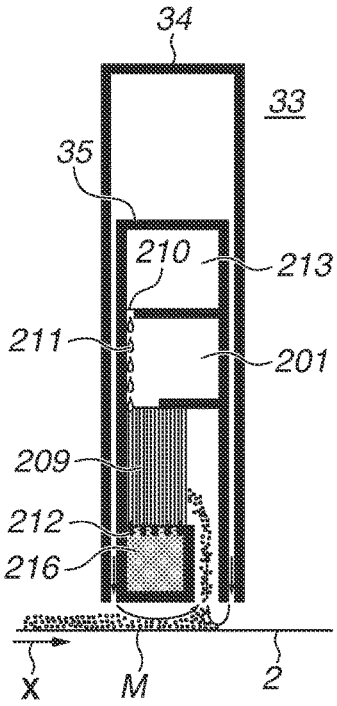
Figure 13C:
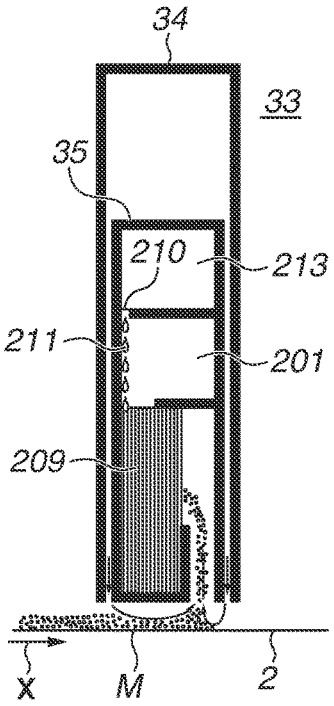

FIG. 13B illustrates a third modification in which the mist collection unit 33 is configured without the drain channel 217 under the liquid transfer member 216. FIG. 13C illustrates a fourth modification in which the liquid transfer member 216 is omitted and the filter 209 is configured as a single large-sized component.

Figure 13D:
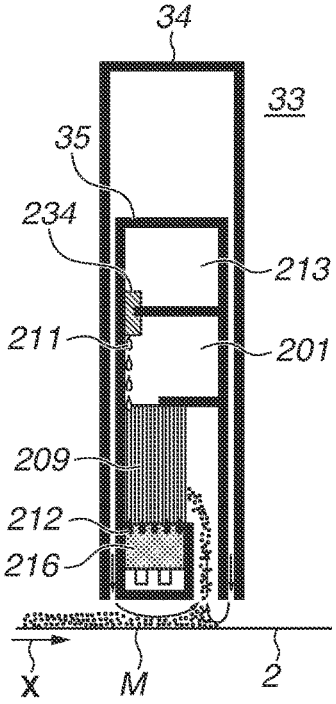
Figure 13E:
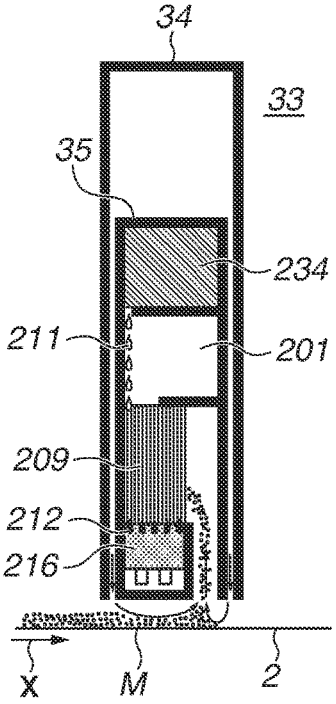

FIG. 13D illustrates a fifth modification in which a porous body 234 is inserted into the holes 210. The liquid 211 seeping out of the porous body 234 moves down by gravity and is supplied to the filter 209. The porous body 234 may be increased in size so that a bottom surface thereof is in contact with the filter 209. FIG. 13E illustrates a sixth modification in which the space in the liquid supply portion 213 is filled with a long narrow porous body 234. The liquid 211 seeping out of the porous body 234 moves down by gravity and is supplied to the filter 209. In both the examples of FIGS. 13D and 13E, the porous body 234 can be hydrophilic with a contact angle of 5° or less. The distribution of the amount of liquid supply in the longitudinal direction of the liquid supply portion 213 becomes more uniform if a PVA or polyurethane porous body is used.

The mist collection in an inkjet recording apparatus (printer) has been described above. However, the present disclosure is not limited to a printer. An example of the present disclosure is widely applicable to mist collection in inkjet apparatuses that include an inkjet head and are intended for purposes other than printing.

According to an exemplary embodiment of the present disclosure, clogging of a filter for capturing ink mist is suppressed by supplying a liquid to the filter.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-133043, filed Jul. 6, 2017, which is hereby incorporated by reference herein in its entirety.

What is claimed is:

1. An inkjet recording apparatus comprising:

a head configured to discharge ink; and a collection unit configured to collect ink mist generated due to a discharge of the ink from the head, wherein the collection unit includes a filter configured to capture the ink mist and a liquid supply portion configured to supply a liquid to the filter.

2. The inkjet recording apparatus according to claim 1, wherein the filter is arranged inside a housing of the collection unit, wherein the liquid supply portion is arranged inside the housing and above the filter, and wherein the liquid moves down from the liquid supply portion toward the filter.

3. The inkjet recording apparatus according to claim 2, wherein the liquid supply portion includes a flow channel arranged along a longitudinal direction of the head, wherein a plurality of holes is formed in the flow channel along the longitudinal direction, and wherein the liquid from each of the plurality of holes moves to an upper part of the filter.

4. The inkjet recording apparatus according to claim 2, wherein a negative pressure generation unit is connected to the housing, and wherein air sucked into the housing from a suction port provided in a bottom part of the collection unit, the air containing the ink mist, is gas-liquid separated by the filter before being exhausted from the housing by negative pressure of the negative pressure generation unit.

5. The inkjet recording apparatus according to claim 4, wherein the air sucked in from the suction port enters the filter from a side surface, passes through the filter, and exits the filter from a top surface.

6. The inkjet recording apparatus according to claim 1, wherein a reception unit configured to receive a waste liquid seeping out of the filter is arranged under the filter, and wherein the inkjet recording apparatus further comprises a draining unit configured to drain the waste liquid in the reception unit from the collection unit.

7. The inkjet recording apparatus according to claim 1, wherein the filter is a fibrous porous body in which fibers have an average fiber-to-fiber distance within a range of 30 μm to 200 μm.

8. The inkjet recording apparatus according to claim 1, wherein a liquid transfer member including a porous body different from the filter is arranged in contact with a lower part of the filter, and wherein the liquid moves from the filter to the liquid transfer member.

9. The inkjet recording apparatus according to claim 8, wherein the liquid transfer member is a continuous open cell porous body having a porosity of 80% or more and a pore size within a range of 50 μm to 600 μm, or a fibrous porous body in which fibers have an average fiber-to-fiber distance within a range of 50 μm to 600 μm.

10. The inkjet recording apparatus according to claim 8, wherein the liquid transfer member has surface energy higher than that of the filter.

11. The inkjet recording apparatus according to claim 1, wherein the filter has a water content within a range of 5% to 30% when the inkjet recording apparatus is in use.

12. The inkjet recording apparatus according to claim 1, wherein a blowing port for blowing out air and a suction port for sucking in air are provided in a bottom part of the collection unit.

13. The inkjet recording apparatus according to claim 1, wherein the head is a line head for recording an image, wherein the collection unit has a shape long in a longitudinal direction of the line head, and wherein a plurality of line heads and a plurality of collection units are alternately arranged.

14. The inkjet recording apparatus according to claim 13, further comprising a transfer drum to which the ink is discharged from the head, wherein the plurality of line heads and the plurality of collection units are radially arranged along a surface of the transfer drum, and wherein an ink image formed on the transfer drum by the plurality of line heads is transferred to a recording medium.

* * * * *